United States Patent [19]

Skedeleski et al.

[11] Patent Number: 4,792,316

[45] Date of Patent: Dec. 20, 1988

[54] SURFBOARD PROTECTIVE TIP

[76] Inventors: David Skedeleski; Eric Arakawa, both of Box 30374, Honolulu, Hi. 96820

[21] Appl. No.: 37,190

[22] Filed: Apr. 10, 1987

[51] Int. Cl.[4] ..... A63C 15/05

[52] U.S. Cl. ..... 441/74; 114/219

[58] Field of Search ..... 114/219, 229; 441/74

[56] References Cited

U.S. PATENT DOCUMENTS

| | | | |
|---|---|---|---|
| 94,948 | 9/1869 | Davis et al. | 114/219 |
| D. 201,530 | 6/1965 | Sacket | D21/230 |
| D. 213,597 | 3/1969 | Joyce | D21/230 |
| D. 216,032 | 11/1969 | Howe | D6/422 |
| 708,476 | 9/1902 | Higgins | 114/219 |
| 3,374,495 | 3/1968 | Joyce | 114/219 |
| 4,006,912 | 2/1977 | Perlich et al. . | |
| 4,167,050 | 9/1979 | Arconette | 114/343 |
| 4,586,451 | 5/1986 | Mori | 114/219 |

FOREIGN PATENT DOCUMENTS

38745/85 6/1985 Australia .

OTHER PUBLICATIONS

Sears 1974 Boating and Fishing Catalog, p. 39, Resurfacing and Repair Kits.

*Primary Examiner*—Sherman D. Basinger
*Assistant Examiner*—Thomas J. Brahan
*Attorney, Agent, or Firm*—Nixon & Vanderhye

[57] ABSTRACT

A protective tip cover for the sharply angled nose portion of a surfboard for reducing or preventing injury to the user upon impact with the nose portion of the board. The cover comprises a relatively soft, resilient (e.g., silicone), generally V-shaped member provided with a gently rounded apex portion and a pair of rearwardly extending wing portions which merge into side surfaces of the board. Upper and lower surfaces of the board are provided with slots extending from the juncture of the wing portions toward the apex. An after market kit is also provided for enhancing the safety of existing boards. The kit includes a surfboard tip cover, suitable primer and adhesive, applicators and installation instructions.

17 Claims, 1 Drawing Sheet

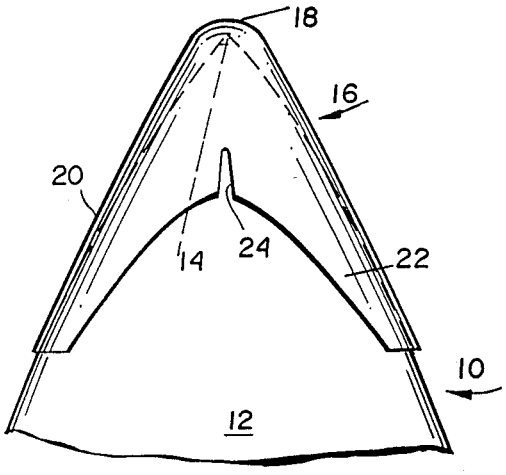
FIG. 1
FIG. 5
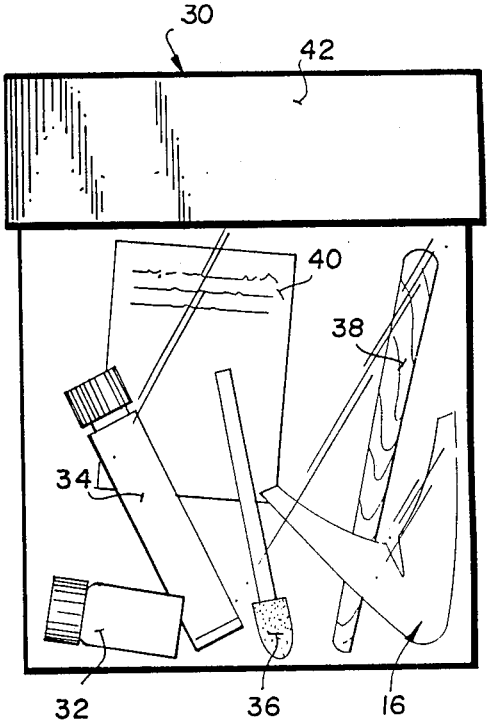
FIG. 3
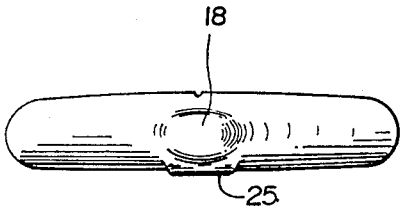
FIG. 2
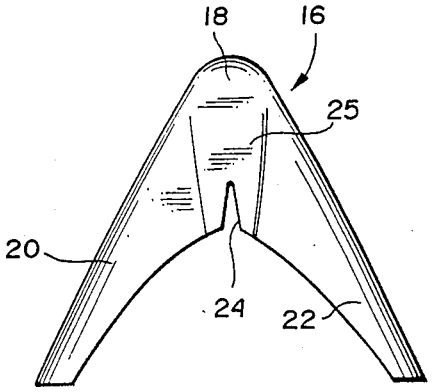
FIG. 4
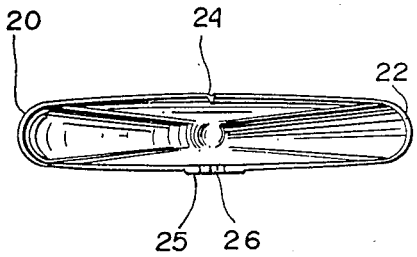

SURFBOARD PROTECTIVE TIP

BACKGROUND AND SUMMARY OF THE INVENTION

This invention relates to a safety device for surfboards, and specifically to a relatively soft protective covering member for the forward tip of a surfboard, and, in a related aspect, to a safety enhancing kit enclosing a protective tip cover along with suitable means for attaching the cover to a surfboard.

Contemporary short surfboards have sharply pointed forward tips which can seriously or fatally injure the user of the board upon loss of control of the board during surfing. Typically, after falling or being thrown from a board, the surfer is exposed to substantial danger from the board itself as the latter is tossed about by the enormous amount of energy generated by ocean waves. The hazard is made worse by the common practice of tying the board to the user's ankle to keep the board in the immediate area of the user, so that the board need not be located and retrieved after each so called "wipe-out".

Despite the obvious and substantial safety hazard presented by these contemporary boards, surfers have resisted attempts to make the boards safer through rounding of the tip or nose portion thereof. This invention provides an alternative safety measure which substantially retains the appearance and performance characteristics of the board, while providing a needed measure of safety for the user. In the present invention, a surfboard tip cover is provided which comprises a generally hollow, substantially V-shaped member which is made of a relatively soft, flexible and resilient silicone material. The device is adapted to fit over the sharply pointed boards and to present an only slightly rounded, yet effective cushion at the tip of the board. The V-shaped cover is further characterized in that notch-like slots are provided on upper and lower surfaces of the cover at the juncture between the main body or tip portion and rearwardly extending wing portions thereof which merge into the side surfaces of the board. These slots allow the device to be effectively applied to boards of slightly different sizes and shapes. The tip cover is designed to be permanently adhered to the tip of the surfboard through the use of suitable means such as silicone adhesive.

The tip cover itself is preferably made of a liquid injected silicone having a durometer A hardness of between about 35 and 40, a tensile strength of about 1150 psi and a tear resistance, Die B, of about pi 160. The rearwardly extending wing portions of the device are feathered along the inside edges thereof to insure smooth merging into the adjacent surfaces of the board.

A further aspect of the invention is the provision for a complete "after market" kit for increasing the safety of existing surfboards. The kit itself includes a tip cover of the type described above, adhesive means including a priming liquid and a silicone adhesive a primer applicator and an adhesive applicator. Also included in the kit may be suitable instructions for attaching the tip cover to the surfboard.

Further objects and advantages of the invention will become apparent from an inspection of the drawings and detailed description of the invention which follows.

BRIEF DESCRIPTION OF THE DRAWINGS

FIG. 1 is a perspective view of the forward portion of a surfboard having a tip cover in accordance with this invention attached thereto;

FIG. 2 is a plan view of a tip cover in accordance with an exemplary embodiment of this invention, illustrating the side opposite that shown in FIG. 1;

FIG. 3 is a front view of the tip cover disclosed in FIG. 2;

FIG. 4 is a rear view of the tip cover disclosed in FIG. 2; and

FIG. 5 is a perspective view of a kit in accordance with the exemplary embodiment of this invention.

DETAILED DESCRIPTION OF THE INVENTION

Referring to FIG. 1, there is illustrated a forward deck portion of a surfboard to which a tip cover in accordance with this invention has been attached. The surfboard 10 is of the contemporary, short type which typically includes a forward portion 12 having a sharply angled nose or tip 14. It is readily apparent that this sharply pointed nose or tip poses a significant safety hazard to anyone coming into contact with the board, either in the water or out. The board is particularly dangerous to the user upon loss of control of the board while surfing. The force of ocean waves propelling a board into contact with a momentarily defenseless user of the board can cause serious and even fatal injury.

The invention her relates to the attachment of a tip cover 16 to the tip 14 of the board 12. The cover has a generally V-shaped configuration wherein the apex of the V is gently rounded at 18. Legs or wing portions 20, 22 extend rearwardly from the apex portion 18 of the device.

As best seen in FIGS. 1 and 4, the tip cover 16 is substantially hollow, each of the rearwardly extending wing portions 20, 22 being formed with a generally trough-like shape so as to partially wrap around and merge into the side edges of the board.

At the juncture of the rearwardly extending wing portions, on both upper and lower surfaces of the cover, notch-like slots 24, 26 are provided to permit the cover to be fitted to boards of slightly different shapes and sizes. As best seen in FIG. 2, additional material may be added to the lower side of the cover in the form of a reinforced portion 25 extending from adjacent the slot 26 and merging into the nose area 18.

The tip cover is preferably constructed of a flexible and resilient liquid injected silicone, having a hardness on the durometer A scale of 35 to 40, a tensile strength of about 1,150 psi, and a tear resistance, Die B, of about pi 160.

The tip cover is preferably applied to the nose or top of a surfboard with a suitable adhesive. In this regard, it is to be understood that the tip of the surfboard need not fit all the way into the tip cover. In fact, pushing the tip into too far may cause distortion of the cover. It is preferable that any space left between the tip of the board and the apex of the cover be filled with the silicone adhesive to provide an even further cushioning effect.

In applying the tip cover to a sharply angled nose portion of a surfboard, it is necessary to first clean the nose area of the board of all wax, sand, dust, etc. It will be understood, of course, that any sharp or rough points on the tip of the surfboard should be removed, as by sanding, etc. Once cleaned, a clear liquid primer is applied to the nose area of the board, and to the inside of the tip cover. Typical primers will dry in about one minute. It will be appreciated that the primer is necessary to promote adherence of the tip cover to the board. A suitable adhesive, such as a silicone glue is subsequently applied inside the tip cover and spread about the inside surface thereof with a suitable applicator. The tip cover is then pushed onto the tip of the board and any excess, exposed adhesive may be wiped away with a cloth or with the applicator. If desirable, masking tape may be used to hold the tip cover in place while the adhesive cures. Curing should be allowed to take place over approximately a twenty-four hour period.

Turning now to FIG. 5, there is illustrated an after market safety enhancing kit in accordance with another aspect of the invention. In FIG. 5, a substantially transparent plastic bag 30 is shown which encloses a tip cover 16 of the type described hereinabove, primer material 32, adhesive 34, a primer applicator 36, and an adhesive applicator 38. Promotional material 40 may also be enclosed if desired. The bag 30 may also be provided along its upper surface with a suitable closure 42, preferably of lightweight cardboard, which may include instructional material printed thereon, although an instruction sheet may be included as part of the promotional material 40 or as a separate sheet inserted in the bag if so desired.

It will thus be appreciated that the invention provides an effective measure of safety for otherwise hazardous surfboards in the form of a relatively inexpensive, and easily attached tip cover which serves to blunt or cushion the impact of the board and thereby reduce the chances of serious injury which might otherwise occur. The tip cover does not alter the overall appearance or performance characteristics of the board, and can be color matched or contrasted as desired.

While the invention has been described in connection with what is presently considered to be the most practical embodiment, it will be apparent to those of ordinary skill in the art that many changes and variations may be made which nevertheless remain within within the spirit and scope of the appended claims.

What is claimed is:

1. In combination with a surfboard of the type having a sharply angled forward tip portion, means for affording protection to the user of the surfboard during surging from injury upon contact with said tip portion while not altering the performance characteristics of the surfboard, said means comprising a relatively soft, resilient, silicone tip cover of generally V-shaped configuration, having a rounded exterior nose portion and rearwardly extending, substantially trough-shaped wing portions which intersect at a juncture defined by a pair of forwardly directed slots, said tip cover being fixedly secured to said tip portion of said surfboard.

2. A combination with a surfboard as recited in claim 1, said means for affording protection to the user consisting of said relatively soft, resilient tip cover of generally V-shaped configuration, and means for permanently affixing said tip cover to said tip portion of said surfboard.

3. The combination as defined in claim 1 wherein said tip cover is constructed of a liquid injected silicone material and wherein said tip cover is secured to said surfboard with silicone adhesive.

4. The combination as defined in claim 3 wherein said tip cover has a durometer A hardness of about 35 to 40, a tensile strength of about 1150 psi and a tear resistance, Die B, of about pi 160.

5. The combination as defined in claim 3 wherein space between the said sharply angled tip portion of said surfboard and said rounded exterior nose portion of said cover is filled with said

6. A protective tip safety cover for the forward tip of a pointed tip surfboard comprising a soft, resilient generally V-shaped cushioning member for affording protection to the user of the surfboard during surfing having a rounded exterior nose portion at a center portion thereof and a pair of rearwardly extending substantially trough-shaped wing portions, said wing portions having edges which intersect at a juncture defined by slot means on upper and lower surfaces thereof extending from the juncture of said wing portions at said center portion toward said nose portion, and wherein each of said wing portions have a thickness which decreases toward said edges.

7. A protective tip cover as defined in claim 6 wherein said member is constructed of a liquid injected silicone material.

8. A protective tip cover as defined in claim 6 wherein said member has a durometer A hardness of about 35 to 40.

9. A protective tip cover as defined in claim 6 and wherein said tip cover is provided with a reinforced region spanning one of said slot means.

10. A kit for improving the safety of surfboards having sharply pointed forward tip portions, while not altering the performance characteristics of the surfboard, comprising:

(a) means for affording protection to the user of the surfboard during surfing form injury upon contact with said tip portion while not altering the performance characteristics of the surfboard, said means comprising a relatively soft, resilient, silicone tip cover of generally V-shaped configuration, having a rounded exterior nose portion and rearwardly extending, substantially trough-shaped wing portions which intersect at a juncture defined by a pair of forwardly directed slots, said tip cover being fixedly secured to said tip portion of said surfboard;

(b) adhesive means for attaching said protector to the tip of a surfboard; and (c) means for applying said adhesive means to said surfboard and said tip protector.

11. A kit as defined in claim 10 wherein said adhesive means comprises a primer and an adhesive.

12. A kit as defined in claim 11 wherein said adhesive comprises silicone adhesive.

13. A kit as defined in claim 10 wherein said member is constructed of a liquid injected silicone.

14. A kit as defined in claim 13 wherein said member has a durometer A hardness of about 35 to 40, a tensile strength of about 1,150 psi, and a tear resistance, Die B, of about psi 160.

15. A safety enhancing kit for use with surfboards of the type having sharply angled forward tip portions, while not altering the performance characteristics of the surfboard, comprising:

(a) a relatively soft, resilient, and flexible liquid injected silicone tip cover for permanent attachment to the tip portion of a surfboard, said tip cover comprising a generally V-shaped cushioning member for affording protection to the user of the surfboard during surfing having a rounded exterior nose portion at a center portion thereof and a pair of rearwardly extending substantially trough-shaped wind portions, said wing portions having edges which intersect at a juncture defined by slot means on upper and lower surfaces thereof extending from the juncture of said wing portions at said center portion toward said nose portion, and wherein each of said wing portions have a thickness which decreases towards said edges;

(b) primer means for preparing the surface of the broad for adhesively mounting said tip cover;

(c) adhesive means for permanently securing said tip cover to said tip portion;

(d) applicator means for said primer and said adhesive means; and (e) disposable enclosure means for holding elements (a) through (d).

16. A kit as defined in claim 15 wherein said tip cover has a durometer A hardness of about 35 to 40.

17. A kit as defined in claim 15 wherein said adhesive means comprises silicone adhesive.

* * * * *

UNITED STATES PATENT AND TRADEMARK OFFICE

CERTIFICATE OF CORRECTION

PATENT NO. : 4,792,316

DATED : December 20, 1988

INVENTOR(S) : David Skedeleski; Eric Arakawa

It is certified that error appears in the above-identified patent and that said Letters Patent is hereby corrected as shown below:

Column 2, line 31, "her" has been changed to --here--; line 44, "26" has been changed to --24--.

Column 3, line 42, "within", second occurrence, has been deleted; line 47, "surg-" has been changed to --surf---.

Column 4, line 34, "form" has been changed to --from--.

Column 5, line 2, "wind" has been changed to --wing--; line 11, "broad" has been changed to --board--.

Signed and Sealed this

Twentieth Day of February, 1990

*Attest:*

JEFFREY M. SAMUELS

*Attesting Officer*

*Acting Commissioner of Patents and Trademarks*